US009424963B1

(12) United States Patent
McNutt et al.

(10) Patent No.: US 9,424,963 B1
(45) Date of Patent: Aug. 23, 2016

(54) MOISTURE MITIGATION IN PREMISE CABLES

(71) Applicant: Superior Essex Communications LP, Atlanta, GA (US)

(72) Inventors: Christopher W. McNutt, Woodstock, GA (US); Wayne Patrick Cheatle, Marietta, GA (US)

(73) Assignee: Superior Essex Communications LP, Atlanta, GA (US)

( * ) Notice: Subject to any disclaimer, the term of this patent is extended or adjusted under 35 U.S.C. 154(b) by 97 days.

(21) Appl. No.: 14/100,758

(22) Filed: Dec. 9, 2013

Related U.S. Application Data

(60) Provisional application No. 61/736,331, filed on Dec. 12, 2012.

(51) Int. Cl.
*H01B 11/02* (2006.01)

(52) U.S. Cl.
CPC ..... *H01B 11/02* (2013.01)

(58) Field of Classification Search
CPC ..... H01B 7/282; H01B 11/02
USPC ..... 174/113 R
See application file for complete search history.

(56) References Cited

U.S. PATENT DOCUMENTS

| | | | | | |
|---|---|---|---|---|---|
| 4,171,463 | A * | 10/1979 | Watkins | A01N 59/08 | 106/15.05 |
| 4,514,466 | A * | 4/1985 | Leon, Jr. | H01B 3/46 | 174/121 A |
| 5,795,652 | A * | 8/1998 | Bell | H01B 3/301 | 174/110 N |
| 2006/0169478 | A1 * | 8/2006 | Clark | H01B 11/04 | 174/113 C |
| 2009/0176093 | A1 * | 7/2009 | Appel | C08L 23/06 | 428/377 |

* cited by examiner

*Primary Examiner* — Timothy Thompson
*Assistant Examiner* — Paul McGee, III

(57) ABSTRACT

Premise cables for installation in indoor environments, such as risers and plenums, are described. A premise cable may include an outer jacket and at least one twisted pair of individually insulated conductors positioned within a cable core defined by the jacket. Moisture mitigation material is positioned between an outer surface of the jacket and the twisted pair(s), for example, within the cable core. The moisture mitigation material is configured to absorb water vapor that penetrates the jacket, thereby improving electrical performance of the cable. However, the moisture mitigation material does not provide water blocking for the cable.

20 Claims, 4 Drawing Sheets

MOISTURE MITIGATION IN PREMISE CABLES

CROSS-REFERENCE TO RELATED APPLICATION

This application claims priority to U.S. Provisional Application No. 61/736,331, filed Dec. 12, 2012, and entitled "Moisture Mitigation in Premise Cables," the entire contents of which are incorporated by reference herein.

TECHNICAL FIELD

Embodiments of the disclosure relate generally to communication cables and, more particularly, to communication cables to be utilized in indoor or premise environments and/or applications.

BACKGROUND

A wide variety of communication cables and/or other types of cables are designed for use in indoor applications. These cables, which are typically referred to as premise cables, may include, for example, riser cables (i.e., cables intended for use in vertical areas between floors in a building) and plenum cables (i.e., cables intended for use in horizontal areas of a building, such as air ducts). Typically, premise cables are designed to satisfy various premise or indoor cabling standards, such as flame retardancy, flame propagation, and/or burn standards. In contrast to outside plant or outdoor cables, premise cables are not designed to satisfy any water blocking standards. However, certain premise cables are installed in areas of a building that may be subject to relatively higher humidity. For example, premise cables may be installed in non-air conditioned environments subject to higher temperatures and humidity, thereby subjecting the cables to increased water vapor. The presence of even the smallest amount of water, such as water vapor that penetrates an outer jacket of a cable, can impact the electrical and mechanical properties of the cable, leading to decreased or degraded cable performance.

The selection of outer jacket materials often plays a role in both water vapor permeation and water absorption characteristics. Polymers with groups containing oxygen, such as nylons, are typically prone to water absorption. Contrarily, polymers containing carbon and hydrogen, as well as their halogenated counterparts, will typically resist or repel water. However, a polymer's ability to resist water or water vapor car be changed dramatically when compounded with other materials that may attract water, such as plasticizers and certain reinforcing and/or non-reinforcing fillers. In addition, temperature fluctuations may affect the ability of a compounded material to resist water. For instance, compounded materials may show little to no susceptibility to water vapor at relatively low to moderate temperatures; however, the same compound may absorb water vapor at elevated temperatures. In other words, regardless of the materials utilized to form a cable jacket, it is possible that water vapor may penetrate the jacket and negatively impact the performance of the cable. Accordingly, there is an opportunity for improved methods and techniques for use in mitigating moisture within premise cables.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Various embodiments of the present disclosure are directed to moisture mitigation techniques, methods, and/or cable components for use with premise cables. Other embodiments of the disclosure are directed to premise cables that include one or more moisture mitigation components and/or moisture mitigation material. Moisture mitigation material may absorb water vapor (or other vapor associated with increased humidity) that penetrates an outer jacket of a premise cable. In this regard, the moisture mitigation material may function to control or regulate humidity within the cable. In other words, the moisture mitigation material may maintain a lower humidity within the cable relative to the ambient environment outside of the cable. The absorption of penetrating water vapor may reduce or prevent degradation of the electrical and/or mechanical properties of the cable, thereby assisting in the maintenance of desired cable performance.

A premise cable is a cable designed for use in indoor environments, such as a use within a building or other structure. Embodiments of the disclosure may be utilized in conjunction with a wide variety of different types of premise cables, such as plenum-rated communication cables and/or riser-rated communication cables. A plenum cable is a cable intended for installation in plenum air ducts or other horizontal spaces, and therefore, may include fire-retardant and/or smoke suppressant materials that limit flame propagation and/or that generate less smoke during a burn situation. A riser cable is a cable intended for use in vertical shafts or spaces, such as shafts between floors in a building. Additionally, certain embodiments of the disclosure may be utilized in conjunction with premise cables that include any number of suitable transmission media, such as one or more twisted pairs of individually insulated conductors.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
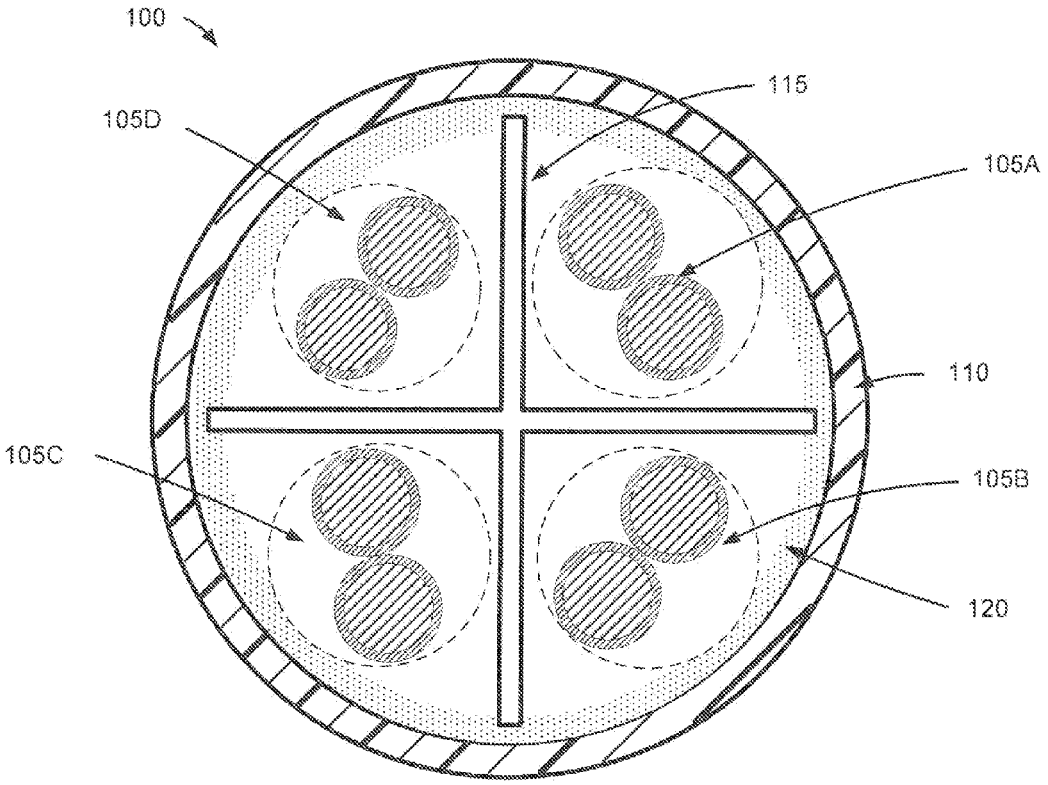
FIG. 1 is a cross-sectional view of an example premise cable including moisture mitigation material loosely positioned within a cable core, according to an illustrative embodiment of the disclosure.

With reference to FIG. 1, a cross-section of an example cable 100 that may be utilized in various embodiments is illustrated. The cable 100 may include a wide variety of suitable transmission media, such as one or more twisted pairs, one or more optical fibers, one or more coaxial cables, and/or one or more power conductors. As illustrated in FIG. 1, the cable 100 may include a plurality of twisted pairs of electrical conductors 105A-D. In other embodiments, the cable 100 may include a combination of twisted pairs and one or more other types of transmission media (e.g., optical fibers, etc.). The illustrated twisted pairs 105A-D may be positioned within an outer jacket 110 of the cable 100. In certain embodiments, the cable 100 may include a separator 115 or filler configured to orient and or position one or more of the twisted pairs 105A-D.

Each twisted pair (referred to generally as twisted pair 105 or collectively as twisted pairs 105) may include two electrical conductors, each covered with suitable insulation. As desired, each of the twisted pairs may have the same twist lay length or alternatively, at least two of the twisted pairs may include a different twist lay length. For example, each twisted pair 105A-D may have a different twist rate. The different twist lay lengths may function to reduce crosstalk between the twisted pairs. As desired, the differences between twist rates of twisted pairs 105 that are circumferentially adjacent one another (for example the twisted pair 105A and the twisted pair 105B) may be greater than the differences between twist rates of twisted pairs 105 that are diagonal from one another (for example the twisted pair 105A and the twisted pair 105C). As a result of having similar twist rates, the twisted pairs that are diagonally disposed can be more susceptible to crosstalk issues than the twisted pairs that are circumferentially adjacent; however, the distance between the diagonally disposed pairs may limit the crosstalk. Thus, the different twist lengths and arrangements of the pairs can help reduce crosstalk among the twisted pairs 105. Additionally, in certain embodiments, each of the twisted pairs 105A-D may be twisted in the same direction (e.g., clockwise, counter clockwise). In other embodiments, at least two of the twisted pairs 105A-D may be twisted in opposite directions.

The electrical conductors may be formed from any suitable electrically conductive material, such as copper, aluminum, silver, annealed copper, gold, or a conductive alloy. Additionally, the electrical conductors may have any suitable diameter, gauge, and/or other dimensions. For example, the electrical conductors may be formed as approximately 23 American Wire Gauge ("AWG") conductors, approximately 24 AWG conductors, or as conductors having any other suitable gauge. In certain embodiments, the electrical conductors may be formed as solid conductors, in other embodiments, the electrical conductors may be formed from a plurality of electrical conductive strands that are twisted together.

The insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. In certain embodiments, the insulation may be formed from multiple layers of a plurality of suitable materials. In other embodiments, the insulation may be formed from one or more layers of foamed material. As desired, different foaming levels may be utilized in accordance with twist lay length to result in insulated twisted pairs having an equivalent or approximately equivalent overall diameter. In certain embodiments, the insulation may additionally include other materials, such as a flame retardant material and/or a smoke suppressant material.

Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair may utilize different insulation materials.

Each twisted pair 105A-D can carry data or some other form of information, for example in a range of about one to ten Giga bits per second ("Gbps") or another appropriate frequency, whether faster or slower. In certain embodiments, each twisted pair 105A-D supports data transmission of about two and one-half Gbps (e.g. nominally two and one-half Gbps), with the cable 100 supporting about ten Gbps (e.g. nominally ten Gbps). In certain embodiments, each twisted pair 105A-D supports data transmission of about ten Gbps (e.g. nominally ten Gbps), with the cable 100 supporting about forty Gbps (e.g. nominally forty Gbps).

The jacket 110 may enclose the internal components of the cable 100, seal the cable 100 from the environment, and provide strength and structural support. The jacket 110 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 110 may be formed as a single layer or, alternatively, as multiple layers. In certain embodiments, the jacket 110 may be formed from one or more layers of foamed material. As desired, the jacket 110 can include flame retardant and/or smoke suppressant materials. Additionally, the jacket 110 may include a wide variety of suitable shapes and/or dimensions. For example, the jacket 110 may be formed to result in a round cable or a cable having an approximately circular cross-section; however, the jacket 110 and internal components may be formed to result in other desired shapes, such as an elliptical, oval, or rectangular shape. The jacket 110 may also have a wide variety of dimensions, such as any suitable or desirable outer diameter and/or any suitable or desirable wall thickness. In various embodiments, the jacket 110 can be characterized as an outer jacket, an outer sheath, a casing, a circumferential cover, or a shell.

An opening enclosed by the jacket 110 may be referred to as a cable core, and the twisted pairs 105A-D may be disposed within the cable core. Although a single cable core is illustrated in the cable 100 of FIG. 1, a cable may be formed to include multiple cable cores. For example, a jacket may be extruded to include multiple cavities. In certain embodiments, the cable core may be filled with a gas such as air. Additionally, in certain embodiments, moisture mitigation material may be incorporated into a cable core. Other elements can be added to the cable core as desired, for example one or more optical fibers, additional electrical conductors, additional twisted pairs, and/or strength members, depending upon application goals.

Figure 3:
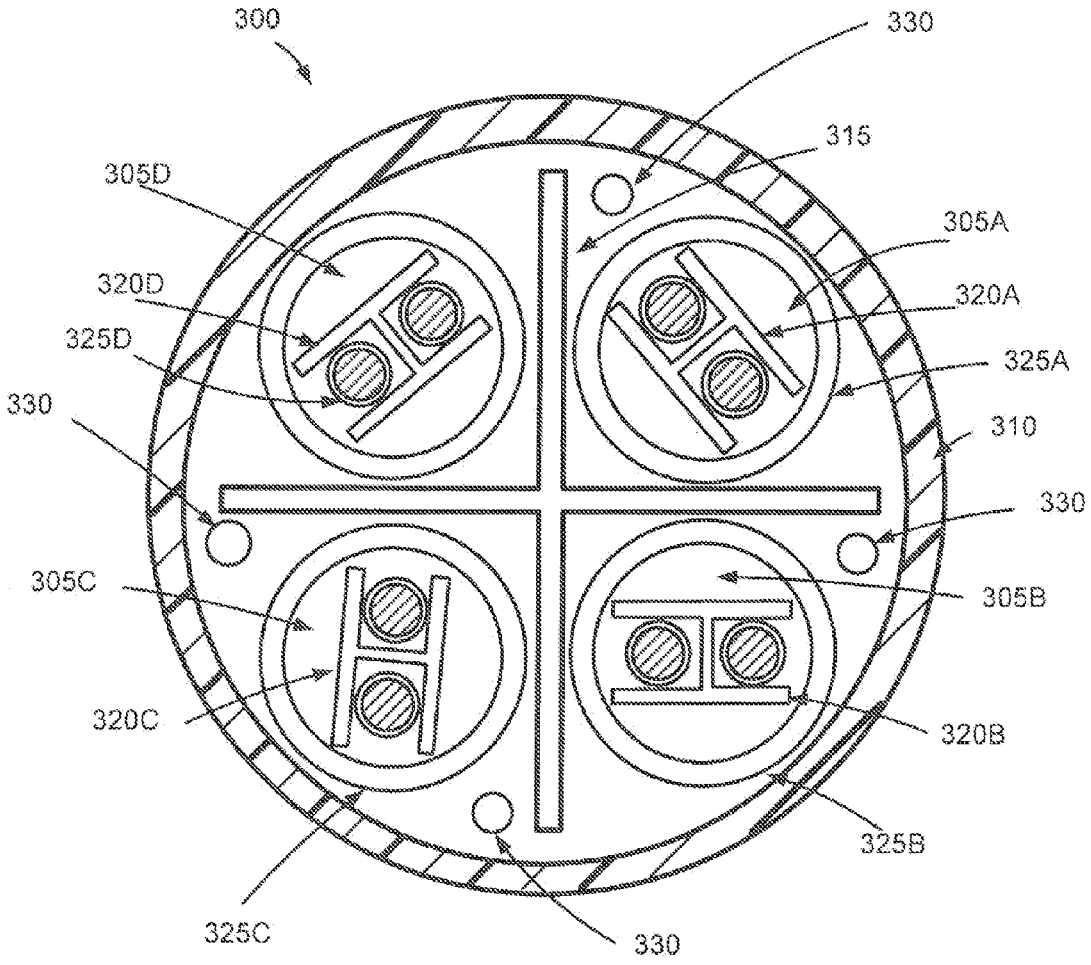
FIG. 3 is a cross-sectional view of an example premise cable including moisture mitigation components, according to an illustrative embodiment of the disclosure.

In certain embodiments, the cable 100 may also include one or more shielding elements. Shielding elements may include, for example, one or more shield layers wrapped around or enclosing one or more of the twisted pairs 105A-D and/or a separation filler 115 that incorporates shielding material. In certain embodiments and as illustrated in FIG. 3, individual shield layers may be provided for one or more twisted pairs. In other embodiments, shield layers may be provided for any desired groupings of twisted pairs. For example, a first shield may be provided for two of the twisted pairs while a second shield is provided for the other two twisted pairs. Additionally, in certain embodiments, an external shield may be provided that encompasses all of the twisted pairs 105 and/or other cable components. Indeed, in various embodiments, any desired shield, combinations of shields, and/or groups of shielding components may be utilized. In other embodiments, the cable may be formed without any shields or other shielding components. Further, in certain embodiments, the cable 100 may include a separate, armor layer (e.g., a corrugated armor, etc.) for providing mechanical protection.

A shield layer, such as an external shield or an individual twisted pair shield, may be formed from a wide variety of suitable materials and/or utilizing a wide variety of suitable techniques. In certain embodiments, a shield layer may be formed as an electrically conductive layer (e.g., a metallic layer), as an electrically conductive foil, or as a braided shield layer. For example, a relatively solid metallic shield layer may be utilized to form a continuous shield. In operation, the shield layer may be grounded when the cable 100 is deployed. In other embodiments, a shield layer may be formed as a plurality of layers. For example, electrically conductive material may be formed on a dielectric substrate (e.g., plastic, polyester, polyethylene, polypropylene, fluorinated ethylene propylene, polytetrafluoroethylene, polyimide, or some other polymer or dielectric material that does not ordinarily conduct electricity etc.) to form a shield layer (e.g., a shield tape). Electrically conductive material may be formed on a dielectric layer via any number of suitable techniques, such as the application of metallic ink or paint, liquid metal deposition, vapor deposition, welding, heat fusion, adherence of patches to the dielectric, etching of patches from a metallic sheet, or selective laser removal of metallic material to form patches. As desired, the electrically conductive material may include discrete patches of material, thereby resulting in a discontinuous shield. In yet other embodiments, a shield layer may be formed from or may include a semi-conductive material. Additionally, in certain embodiments, a shield layer may be formed as a continuous layer along a longitudinal length of the cable 100. In other embodiments, a shield layer may include a plurality of separate segments or components along a longitudinal length of the cable 100. As desired, one or more adjacent shield layer components may overlap one another along shared longitudinal edges. Alternatively, spaces or gaps may be present between certain shield layer components.

In certain embodiments, the cable 100 may also include a separator 115 or filler configured to orient and/or position one or more of the twisted pairs 105. The orientation of the twisted pairs 105 relative to one another may provide beneficial signal performance. As desired in various embodiments, the separator 115 may be formed in accordance with a wide variety of suitable dimensions, shapes, or designs. For example, a rod-shaped separator, a flat tape separator, a flat separator, an X-shaped or cross-shaped separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized. Additionally, a wide variety of suitable techniques may be utilized to form a separator 115. For example, in certain embodiments, material may be cast or molded into a desired shape to form the separator 115. In other embodiments, a tape may be formed into a desired shape utilizing a wide variety of folding and/or shaping techniques. For example, a relatively flat tape separator may be formed into an X-shape or cross-shape as a result of being passed through one or more dies. Additionally, in certain embodiments, a separator 115 may be formed to include one or more hollow cavities that may be filled with air or some other gas, moisture mitigation material, one or more optical fibers, one or more metallic conductors (e.g., a drain wire, etc.), shielding, or some other appropriate material or element.

In certain embodiments, the separator 115 may be continuous along a length of the cable 100. In other embodiments, the separator 115 may be non-continuous or discontinuous along a length of the cable 100. In other words, the separator 115 may be separated, segmented, or severed in a longitudinal direction such that discrete sections or portions of the separator 115 are arranged longitudinally (e.g., end to end) along a length of the cable 100. Use of a non-continuous or segmented separator may enhance the flexibility of the cable 100, reduce an amount of material incorporated into the cable 100, and/or reduce the cable cost.

The separator 115 may be formed from a wide variety of suitable materials as desired in various embodiments. For example, the separator 115 and/or various separator segments can include paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulplhonated polyethylene, flame retardant PVC, low temperature oil resistant PVC, flame retardant polyurethane, flexible PVC, or any other suitable material or combination of materials. As desired, the separator 115 may be filled, unfilled, foamed, solid, homogeneous, or inhomogeneous and may or may not include additives (e.g., flame retardant and/or smoke suppressant materials). As desired, the separator 115 may include one or more strength members, fibers, threads, and/or yarns. Similarly, flame retardant material, smoke suppressants, and/or other desired substances may be blended or incorporated into a separator 115.

In certain embodiments, each segment or portion of the separator 115 may be formed from similar materials. In other embodiments, a separator 115 may make use of alternating materials in adjacent portions or segments. For example, a first portion or segment of the separator 115 may be formed from a first set of one or more materials, and a second portion or segment of the separator 115 may be formed from a second set of one or more materials. As one example, a relatively flexible material may be utilized in every other portion of a separator 115. As another example, flame retardant material may be selectively incorporated into desired portions of a separator 115. In this regard, material costs may be reduced while still providing adequate flame retardant qualities.

In certain embodiments, a separator 115 (or various separator segments) may include or incorporate electrically conductive material that functions as a shield (or partial shield). For example, a separator 115 may include electrically conductive material, such as one or more metallic patches (or other suitable conductive material) formed on or adhered to a dielectric substrate or base. As another example, a separator 115 may include electrically conductive material embedded into or impregnated into a dielectric material. As yet another example, a separator 115 may include relatively solid sections of electrically conductive material, such as discrete electrically conductive segments incorporated into a segmented separator or electrically conductive sections incorporated into a continuous separator (or various separator segments of a discontinuous separator). Similar to a shield layer, a separator 115 may utilize a wide variety of different configurations of electrically conductive material in order to provide shielding. In certain embodiments, electrically conductive material incorporated into a separator 115 (or separator segment) may be continuous or relatively continuous along a length of the separator 115. In other embodiments, discontinuous patches of electrically conductive material may be incorporated into the separator 115 and/or various separator segments. In yet other embodiments, semi-conductive material may be incorporated into the separator 115.

As set forth above, a wide variety of different types of shielding elements and/or combinations of shielding elements may be incorporated into a cable 100. These shielding elements may utilize a wide variety of different materials and/or have a wide variety of suitable configurations. For example, a wide variety of suitable electrically conductive materials or combination of materials may be utilized in a shielding element including, but not limited to, metallic material (e.g., silver, copper, annealed copper, gold, aluminum, etc.), metallic alloys, conductive composite materials, etc. indeed, suitable electrically conductive materials may include any material having an electrical resistivity of less than approximately $1\times10^{-7}$ ohm meters at approximately 20° C., such as an electrical resistivity of less than approximately $3\times10^{-8}$ ohm meters at approximately 20° C. In the event that discontinuous patches or sections of electrically conductive material are utilized, the patches may have any desired dimensions, such as any desired lengths and/or thicknesses. Further, any desired gaps or spaces may be positioned between adjacent patches. Further, electrically conductive material incorporated into a shield element may have a wide variety of suitable arrangements and/or shapes.

A shielding element may include any number of patches of electrically conductive material. For example, a single electrically conductive patch may form a relatively continuous shield along a longitudinal length of a shielding element. Alternatively, a plurality of electrically conductive patches may be provided that are electrically isolated from one another to form a discontinuous shield. The electrical isolation may result from gaps or spaces between electrically conductive patches, such as gaps of dielectric material and/or air gaps (e.g., gaps between adjacent separator segments, etc.). The respective physical separations between the patches may impede the flow of electricity between adjacent patches.

Electrically conductive patches or sections may include a wide variety of suitable dimensions, for example, any suitable lengths in the longitudinal direction, any suitable gap lengths or spaces between adjacent patches, and/or any suitable thicknesses. Additionally, a plurality of patches may be formed in accordance with a pattern or in random fashion. As desired, the dimensions can be selected to provide electromagnetic shielding over a specific band of electromagnetic frequencies or above or below a designated frequency threshold. Additionally, in certain embodiments, the patches may be formed as first patches (e.g., first patches on a first side of a dielectric material), and second patches may be formed on an opposite side of the dielectric material (or on another dielectric material). For example, second patches may be formed to correspond with the gaps or isolation spaces between the first patches. Additionally, each electrically conductive patch may include a coating of metal having any desired thickness, such as a thickness of about 0.5 mils (about 13 microns) or greater. A wide variety of patch configurations including different dimensions can be utilized.

Additionally, in certain embodiments, a dielectric separator or demarcator may be positioned between the individual conductive elements or electrical conductors of one or more of the twisted pairs 105. For example, a respective dielectric separator may be positioned between the individual conductors of each of the twisted pairs 105. In certain embodiments, a dielectric separator may be woven helically between the individual conductors or conductive elements of a twisted pair 105. In other words, the dielectric separator may be helically twisted with the conductors of the twisted pair 105 along a longitudinal length of the cable 100. The dielectric separator may maintain spacing between the individual conductors of the twisted pair 105 and/or maintain the positions of one or both of the individual conductors.

A dielectric separator may be formed with a wide variety of suitable shapes and/or dimensions. For example, in certain embodiments, the dielectric separator may be formed as a tape or film that is positioned between the conductors of a twisted pair 105 and permitted to at least partially conform to the outer circumferences of the twisted pairs. In other embodiments, a dielectric separator may be formed with any other desired cross-sectional shape (i.e., a cross-sectional shape taken at a point along the lengthwise or longitudinal direction of the separator and cable), such as an H-shape, a T-shape, an X-shape, an E-shape, a Z-shape, an S-shape, a K-shape, etc. As such, a dielectric separator may form at least one cavity in which one or both of the insulated conductors of a twisted pair 105 is situated or positioned, thereby assisting in maintaining the alignments, orientations, and/or positions of the conductors when forces are exerted on the cable 100. For example, when mechanical stresses and/or compressive forces are applied to the cable 100 (e.g., stresses during shipment of the cable, stresses during cable installation, environmental forces, etc.), the dielectric separator may assist in holding the conductors in place. As a result, shifting, sliding, and/or other movement of the various conductors incorporated into the cable 100 may be reduced or limited, thereby improving overall cable performance.

A dielectric separator may be formed from a wide variety of suitable materials and/or combinations of materials. For example, the dielectric separator can include paper, metals (e.g., copper, steel, aluminum, etc.), alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), poly-urethane, neoprene, cholorosuphonated polyethylene, flame retardant PVC, low temperature oil resistant PVC, flame retardant polyurethane, flexible PVC, glass fibers, one or more composite materials, one or more relatively nonconductive nanomaterials, or any other suitable material or combination of materials. As desired, the dielectric separator may be solid, filled, unfilled, foamed, homogeneous, or inhomogeneous and may or may not include additives (e.g., flame retardant and/or smoke suppressant materials).

For a premise cable 100, it is possible that water vapor may penetrate the outer jacket 110 of the cable 100. Accordingly, one or more moisture mitigation materials and/or components may be incorporated into the cable 100. For example, one or more moisture mitigation or moisture absorption components may be situated within or incorporated into the cable 100 between the one or more twisted pairs 105 and an outer periphery of the cable 100. The moisture mitigation components may be primarily concerned with absorbing any water vapor (or other liquid in vapor or gas form) that penetrates the outer jacket 110 of the cable 100 to prevent the water vapor from degrading cable performance. Examples of different types of water vapor that may penetrate the cable 100 and be absorbed by a moisture mitigation component include, but are not limited to, steam and water vapor due to humidity. The moisture mitigation components may draw the water vapor out of the air or atmosphere once the water vapor penetrates the cable 100, thereby lowering the humidity inside the cable 100 relative to the cable's external environment. As a result, cable integrity and performance may be maintained at desirable levels.

A wide variety of different types of moisture mitigation materials and/or components may be incorporated into the cable 100 as desired in various embodiments. As illustrated in FIG. 1, in certain embodiments, moisture mitigation material 120 may be inserted into or situated within the interstices of the cable 100. For example, loose moisture mitigation material 120 may be positioned with in a cable core. The moisture mitigation material 120 may be free to migrate or shift around within the cable core. For example, the material 120 may settle at the bottom of a cable core when the cable 100 is installed in an approximately horizontal orientation (e.g., as a plenum cable). As desired in various embodiments, one or more spacers or dams may be incorporated into a cable core in order to maintain moisture mitigation material 120 in desired sections or compartments. In this regard, material 120 may be maintained in various compartments in the event that the cable 100 is installed vertically (e.g., as a riser cable).

A wide variety of suitable materials and/or combinations of materials may be utilized, as moisture mitigation material 120. Examples of suitable materials include a wide variety of dessicants and/or hygroscopic materials including, but not limited to, activated alumina salt, other metallic salts, aerogel, benzophenone, bentonite clay, calcium chloride, calcium oxide, calcium sulfate, cobalt chloride, copper sulfate, lithium chloride, lithium bromide, magnesium sulfate, magnesium perchlorate, molecular sieves, potassium carbonate, silica gel, sodium, sodium chlorate, sodium hydroxide, sodium sulfate, sucrose, etc. Other materials that may be utilized as moisture mitigation materials include, but are not limited to, various polymeric materials that absorb moisture, such as polyacrylate, polyacrylamide copolymer, sodium polyacrylate, and/or a wide variety of other absorbent polymers and/or superabsorbent polymers.

In certain embodiments, loose moisture mitigation material 120 may be in the form of powder or other substance containing particulate matter. Additionally, the various particles may have any desired dimensions and/or sizes. For example, the particles may have diameters of approximately 100 microns, approximately 200 microns, approximately 300 microns, approximately 400 microns, diameters included in a range between any two of the above values, diameters smaller than approximately 100 microns, or diameters greater than approximately 400 microns. Relatively smaller particles may increase the ability of the powder to absorb water vapor and/or moisture because the resulting powder will have a relatively larger surface area to volume ratio. However, relatively larger diameter particles may be utilized.

Any of the above materials may be configured to absorb water vapor that penetrates the outer jacket 110 of the cable 100. In other embodiments, one or more materials may be incorporated into a plenum cable 100 in order to block water vapor from penetrating into a cable core. In other words, suitable vapor or moisture blocking materials may be utilized to form a shield to prevent moisture from penetrating into a cable core. Examples of suitable moisture blocking materials include, but are not limited to, diatomaceous earth, clay, moisture blocking gels, etc.

Figure 2:
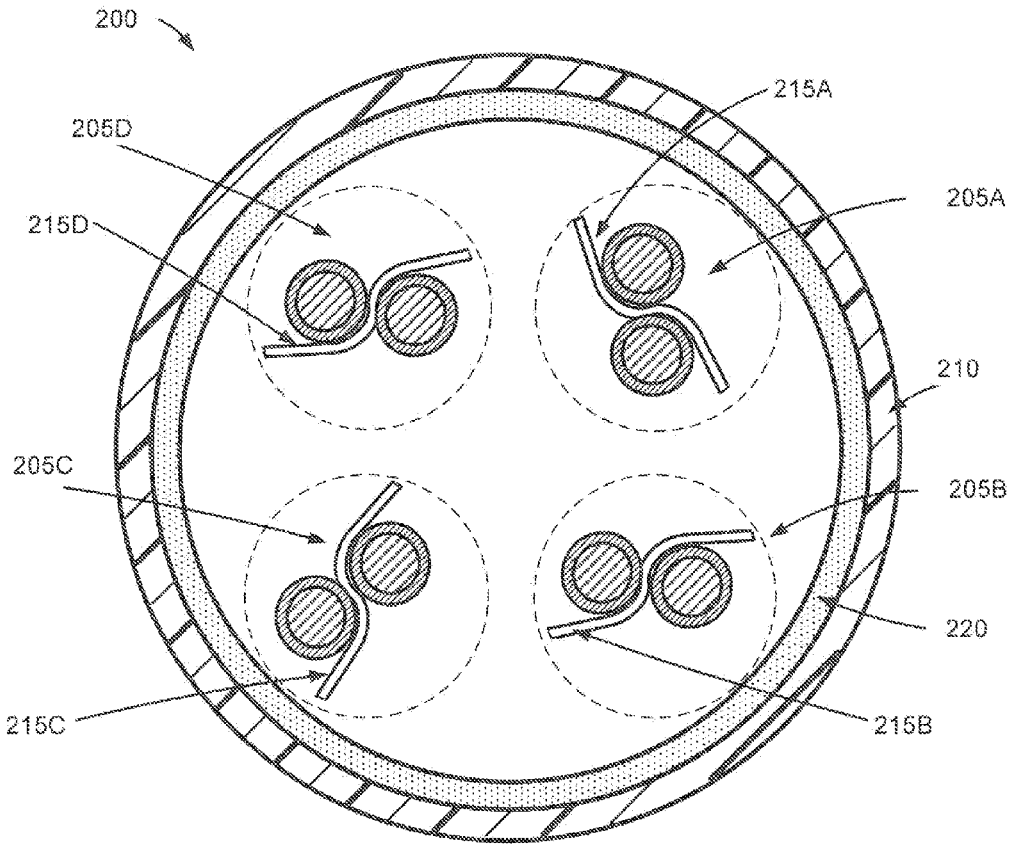
FIG. 2 is a cross-sectional view of an example premise cable including a tape or wrap for mitigating moisture within the cable, according to an illustrative embodiment of the disclosure.

As set forth above, in certain embodiments, the moisture mitigation material 120 may be free to migrate or move within the cable 100. Thus, the material 120 may settle at least in part against an internal surface of the outer jacket 110 (or any tape, wrap, or other layer within the outer jacket 110) once the cable 100 is installed. For example, once the cable 100 is installed, the material 120 may rest at the bottom of cable core formed by the outer jacket 110. Although such an arrangement may not be suitable for conventional water blocking in outdoor cables, the material 120 may still provide adequate water vapor protection within premise environments. As illustrated in FIG. 2, in other embodiments, one or more moisture mitigation materials may be applied to a tape, wrap, or other component that is positioned between the twisted pairs 105 and outer jacket 110 of a cable. The tape or wrap may partially or completely encircle the twisted pairs 105 In yet other embodiments, a suitable layer (e.g., a tape, etc.) may be positioned between the twisted pairs 105 and outer jacket 110 of a cable, and one or more moisture mitigation materials may be positioned between the layer and the outer jacket 110 of the cable. In this regard, the layer may prevent the moisture mitigation materials from contacting the twisted pairs 105 of the cable.

As discussed in greater detail below with reference to FIG. 3, in yet other embodiments, a moisture mitigation tape, yarn, or other component may be positioned within a cable core. For example, a water absorbing yarn (e.g., polyester yarn, aramid yarn, etc.) may be positioned within the cable to provide moisture mitigation. As another example, one or more molecular sieves may be positioned within the outer jacket of a cable. In yet other embodiments and as discussed below with reference to FIG. 4, moisture mitigation materials and/or components may be incorporated into an outer jacket 110 of a cable. For example, moisture mitigation materials (e.g., powders, etc.) may be incorporated into a jacket 110 prior to or during the extrusion of the jacket 110. As another example, a jacket 110 may be extruded or otherwise formed around any number of moisture mitigation components.

As desired in various embodiments, moisture mitigation components and/or moisture mitigation materials may be either continuously or discontinuously incorporated into a cable 100. For example, a powder or other material may be continually positioned or incorporated into a cable 100 (e.g., positioned in a relatively continuous manner along a longitudinal length of the cable 100). Alternatively, moisture mitigation material may be inserted at regular intervals within the cable 100, such as every half meter, every meter, etc. As another example, a tape may be included as a continuous tape or, alternatively, as a discontinuous tape having longitudinal spaces between adjacent components. In yet other embodiments, multiple types of moisture mitigation material may be incorporated into a cable with each type of material being either continuously or discontinuously incorporated.

In certain embodiments, one or more other types of materials may be mixed, blended, or combined with moisture mitigation material or desired portions or sections of moisture mitigation material. For example, flame retardant materials and/or smoke suppressants may be combined with moisture mitigation material. As one example, flame retardant material may be blended with a desiccant powder. As another example, flame retardant materials may be combined with moisture mitigating yarns, strings, or tapes that may contribute fuel to a burn.

Moisture mitigation for premise cables, which is provided by various embodiments of the disclosure, may be distinguishable from water blocking provided in other types of cables. In metal conductor (e.g., copper, etc.) cables, conventional water blocking is primarily utilized for cables that are subject to an outside environment, such as outdoor cables and underwater cables. Conventional water blocking techniques are concerned with preventing liquid water from penetrating the cable and migrating along the cable. Indeed, water blocking standards applicable to outdoor cables typically require that penetrating water (e.g., water coming through an end of the cable or a damaged portion of the cable) be prevented from migrating more than one meter along a longitudinal length of the cable within a 24 hour time period.

By contrast, premise cables that incorporate moisture mitigation materials will likely fail water blocking standards. As set forth herein, moisture mitigation is primarily concerned with the absorption of penetrating water vapor when a cable is installed in a premise environment, it is unlikely that a premise cable will be exposed to relatively large amounts of liquid water, such as amounts of water encountered in an outdoor environment. Thus, a premise cable incorporating moisture mitigation material will be able to absorb limited amounts of penetrating water vapor; however, the cable would likely fail water blocking standards applicable to outdoor cables. In other words, liquid water would likely penetrate or migrate more than one meter along the premise cable within a 24 hour time period.

Additionally, in certain embodiments, the absorption of water vapor may be accomplished with components that would not be utilized for conventional water blocking in outdoor cables. For example, desiccant powders would likely not be utilized for water blocking purposes in outdoor cables. Moreover, relatively small amounts of desiccant powders would not be utilized for water blocking in outdoor cables. Although the desiccant powder may absorb some water vapor, the desiccant powder would not prevent water migration. As another example, water absorbing yarns likely would not be utilized for water blocking in conventional metal conductor cables because the yarns may negatively impact the mutual capacitance of the cable. However, it may be possible to use a relatively small quantity of a water absorbing or water blocking yarn as a moisture mitigation component in a premise cable.

Further, unlike premise cables, outdoor cables are not required to satisfy flame retardancy, flame propagation, burn, or smoke standards. By contrast, embodiments of the disclosure may provide for moisture mitigation while also satisfying one or more flame retardancy, flame propagation, burn, and/or smoke standards applicable to premise cables. For example, a premise cable incorporating moisture mitigation material may satisfy flame and/or smoke requirements of Underwriter Laboratories ("UL") Standard 444, Telecommunications Industry Association ("TIA") Standard 56A, and/or a wide variety of other suitable standards. By contrast, outdoor cables and/or underwater cables typically utilize water blocking components that would contribute enough fuel to a fire to prevent the cables from satisfying premise cable burn and/or smoke standards. Indeed, the heat of combustion of desiccants suitable for use as moisture mitigation material may be lower than that of filling compounds utilized for water blocking in outdoor cables. As a result, the use of desiccants as moisture mitigation materials may result in cables that satisfy burn and/or smoke standards while the use of outdoor cable water blocking materials would fail.

A wide variety of conventional water blocking techniques are also utilized in conjunction with outdoor fiber optic cables and composite or hybrid cables that include optical fibers. However, these techniques are similar to those discussed above for outdoor metal cables, and the water blocking materials would likely result in failure of burn and/or smoke requirements applicable to premise cables. Additionally, with cables containing optical fibers, microbending and/or flexibility concerns typically limit the size of water blocking materials. By contrast, relatively larger materials may be utilized fbr moisture mitigation in metal conductor premise cables. For example, materials or particles having a diameter or other dimension greater than approximately 400 microns may be utilized for moisture mitigation in premise cables. Additionally, certain cables in accordance with embodiments of the disclosure may be free of optical fibers.

As desired in various embodiments, a wide variety of other materials may be incorporated into the cable 100. For example, as set forth above, the cable 100 may include any number of conductors, twisted pairs, optical fibers, and/or other transmission media. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, and/or other materials.

FIG. 2 is a cross-sectional view of an example premise cable 200 including a tape or wrap suitable for mitigating moisture within the cable 200, according to an illustrative embodiment of the disclosure. The cable 200 of FIG. 2 may be similar to the cable 100 of FIG. 1. For example, the cable 200 may include any number of twisted pairs (e.g., four twisted pairs 205A-D) and an outer jacket 210. However, the cable 200 is illustrated as not including a separator, although a separator could be utilized as desired. Additionally, the illustrated cable includes respective dielectric films 215A-D positioned between the conductors of each twisted pair 205A-D. As explained in greater detail above, these dielectric films 215A-D may assist in maintaining a desired separation between the conductors of each pair.

Further, rather than loose moisture mitigation material situated in a cable core, the cable 200 of FIG. 2 is illustrated as including a moisture mitigating tape 220 or wrap situated between the twisted pairs 205A-D and an inner surface of the outer jacket 210. In certain embodiments, the tape 220 may completely encircle, surround, or entrap the twisted pairs 205A-D. In other embodiments, the tape 220 may partially encircle or surround the twisted pairs 205A-D. In yet other embodiments, a plurality of tapes or wraps may be provided, such as individual tapes for one or more of the twisted pairs 205A-D or tapes that at least partially encircle various groups of twisted pairs 205A-D.

A moisture mitigating tape 220 may be formed from any number of suitable materials and/or combinations of materials. For example, in certain embodiments, a moisture mitigating tape 220 may be formed from a suitable polymer that absorbs water vapor or from a water absorbent yarn (e.g., a polyester yarn, etc.). In other embodiments, a moisture mitigating tape 220 may include a base layer (e.g., a polymeric layer, a fluoropolymeric layer, a dielectric layer, a layer formed from a flame retardant material, a plastic layer, etc.) and moisture mitigation material may be adhered to, formed on, or incorporated into the base layer. Examples of suitable moisture mitigation materials that may be utilized in association with a base layer include, but are not limited to, a wide variety of dessicants and/or hygroscopic materials, various polymeric materials that absorb moisture (e.g., polyacrylate, polyacrylamide copolymer, sodium polyacrylate, etc.), and/or a wide variety of other absorbent polymers and/or superabsorbent polymers. In other embodiments, one or more water blocking materials may be incorporated into a tape or utilized to form a tape that will block water vapor from penetrating into a cable core. Examples of suitable moisture blocking materials include, but are not limited to, diatomaceous earth, clay, moisture blocking gels, etc.

The moisture mitigating tape 220 may be configured to absorb water vapor that penetrates the outer jacket 210 of the cable 200. As set forth above, each tape 220 utilized in a cable may either completely or partially encircle one or more of the twisted pairs 205A-D, Additionally, in certain embodiments, a tape 220 may be continuous along a longitudinal length of the cable 200. In other embodiments, a tape 220 may be discontinuous (i.e., include gaps between adjacent sections) along a longitudinal length of the cable.

Further, as desired in certain embodiments, a tape 220 may include a wide variety of materials other than moisture mitigation materials. For example, a tape 220 may include shielding material (e.g., one or more metallic patches), and the tape 220 may function as both a shielding layer and a moisture mitigation layer. As another example, a tape 220 may include flame retardant materials, and/or smoke suppressing materials. In this regard, the tape 220 may provide both moisture mitigation and improved burn performance.

In certain embodiments, moisture mitigation material may be applied to or formed on a single side of a tape 220. In other embodiments, moisture mitigation material may be applied on both sides of a tape 220. In yet other embodiments, moisture mitigation material may be sandwiched between two layers of a tape. Additionally, in certain embodiments, the use of a tape 220 may restrict or prevent the moisture mitigation material from contacting the twisted pairs 205A-D of the cable 210. Further, moisture penetrating the outer jacket 210 may be absorbed by the moisture mitigation materials prior to reaching the twisted pairs 205A-D.

FIG. 3 is a cross-sectional view of another example premise cable 300 that includes moisture mitigation material. The cable 300 of FIG. 3 may be similar to the cable 100 of FIG. 1. For example, the cable 300 may include any number of twisted pairs (e.g., four twisted pairs 305A-D), an outer jacket 310 and, in certain embodiments, a separator 315. However, the illustrated cable includes respective dielectric separators 320A-D positioned between the conductors of each twisted pair 305A-D. Rather than the dielectric films 215A-D illustrated in FIG. 2, the dielectric separators 320A-D may be formed with a suitable cross-sectional shape (e.g., an H-shape) that includes one or more cavities into which the conductors of each twisted pair 305A-D may be situated. In this regard, the dielectric separators 320A-D may maintain desired separation between the conductors of each pair 305A-D and limit or prevent the conductors from shifting or moving as stresses are exerted on the cable 300. Additionally, in contrast to the cable 100 of FIG. 1, the cable 300 of FIG. 3 is illustrated as including respective individual shield layers 325A-D for each of the twisted pairs 305A-D. It will be appreciated that a wide variety of separator, dielectric separator, and/or shielding combinations may be utilized as desired in various embodiments.

Further, rather than loose moisture mitigation material (e.g., a loose powder, etc.) situated in a cable core, the cable 300 of FIG. 3 may include one or more moisture mitigation components 320. For example, one or more moisture mitigation components 320 may be situated between the twisted pairs 305A-D and an outer periphery of the jacket 310 (e.g., within a cable core). In certain embodiments, one or more moisture mitigation components 320 may be loosely positioned within a cable core, allowing the moisture mitigation components 320 to migrate within the cable core. In other embodiments, one or more moisture mitigation components 320 may be adhered to, formed on, and/or incorporated into other components of a cable 300, such as a shield layer or separator 315.

A wide variety of suitable moisture mitigation components 320 may be utilized as desired in various embodiments. For example, one or more water absorbing yarns (e.g., polyester yarns, aramid yarns, etc.) may be positioned within the cable 300 to provide moisture mitigation. As another example, one or more molecular sieves may be positioned within the cable 300. Other example moisture mitigation components will be appreciated by those of ordinary skill in the art. Further, as desired in various embodiments, one or more moisture mitigation components 320 included in a cable 300 may be continuous or, alternatively, discontinuous along a length of the cable 300.

In certain embodiments, the number of moisture mitigation components 320 (e.g., yarns, etc.) and/or the dimensions of the moisture mitigation component(s) 320 may be selected in order to limit any negative mutual capacitance effects on the cable 300. For example, fewer and/or relatively smaller moisture mitigation components may be utilized in a premise cable as opposed to corresponding water blocking components in an outdoor cable. In this regard, penetrating water vapor may be absorbed; however, water blocking would not be provided by the cable 300. Additionally, as desired in certain embodiments, the number and/or dimensions of moisture mitigation component(s) 320 may be selected in order to provide desirable flame retardancy for a plenum cable. For example, moisture mitigation components 320 may be sized to permit a cable 300 to satisfy one or more flame propagation, burn, and/or smoke standards. In certain embodiments, flame retarding material may be combined with one or more moisture mitigation components 320. For example, flame retardant material may be incorporated into, affixed to, intertwined with, and/or otherwise associated with a water absorbing yarn.

Figure 4:
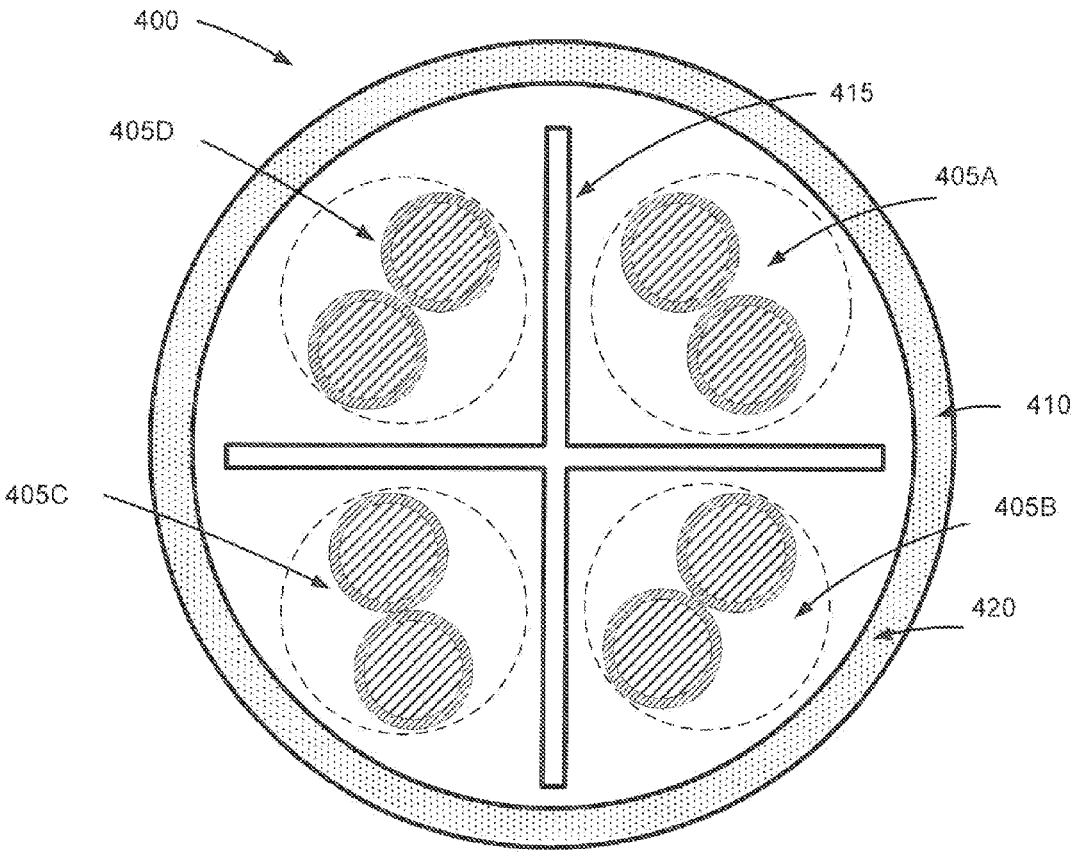
FIG. 4 is a cross-sectional view of an example premise cable in which a jacket material includes a moisture mitigation additive, according to an illustrative embodiment of the disclosure.

FIG. 4 is a cross-sectional view of an example premise cable 400 in which a jacket material includes or incorporates moisture mitigation material, according to an illustrative embodiment of the disclosure. The cable 400 of FIG. 4 may be similar to the cable 100 of FIG. 1. For example, the cable 400 may include any number of twisted pairs (e.g., four twisted pairs 405A-D), an outer jacket 410 and, in certain embodiments, a separator 415. However, rather than moisture mitigation material situated in cable interstices or in a cable core, the cable 400 of FIG. 4 may include moisture mitigation materials 420 and/or components (e.g., water absorbing yarns, molecular sieves, etc.) incorporated into the outer jacket 410.

A wide variety of suitable moisture mitigation materials 420 may be incorporated into the outer jacket 410 as desired in various embodiments. These moisture mitigation materials may include, for example, but are not limited to, a wide variety of dessicants and/or hygroscopic materials, various polymeric materials that absorb moisture (e.g., polyacrylate, polyacrylamide copolymer, sodium polyacrylate, etc.), and/or a wide variety of other absorbent polymers an d/or super-absorbent polymers. In other embodiments, one or more moisture mitigation components, such as yarns and/or molecular sieves, may be incorporated into the outer jacket 410. In yet other embodiments, one or more water blocking materials may be incorporated into a jacket 410 (e.g., formed as a layer between two jacket layers) to block water vapor from penetrating into a cable core. Examples of suitable moisture blocking materials include, but are not limited to, diatomaceous earth, clay, moisture blocking gels, etc.

A wide variety of suitable methods and/or techniques may be utilized to incorporate moisture mitigation materials 420 and/or components into the outer jacket 410. For example, moisture mitigation materials 420 may be incorporated into the jacket 410 and/or material utilized to form the jacket 410 prior to and/or during the extrusion of the jacket 410. In certain embodiments, moisture mitigation material 420 may be blended with the materials (e.g., thermoplastic materials, etc.) utilized to form or extrude the jacket 420. As another example, the jacket 410 may be extruded or otherwise formed around any number of moisture mitigation components. As desired in various embodiments, a moisture mitigation component or moisture mitigation materials may be continuously or discontinuously incorporated into the jacket 410 in a longitudinal direction and/or along the circumference of the jacket 410.

Similar to the cable 100 of FIG. 1, a wide variety of other materials may be incorporated into the cables 200, 300, 400 of FIGS. 2-4 as desired in various embodiments. For example, a cable may be formed to include any number of conductors, twisted pairs, optical fibers, and/or other transmission media. As desired, one or more tubes or other structures may be situated around various transmission media and/or groups of transmission media. Additionally, in various embodiments, a cable may include a wide variety of strength members, swellable materials (e.g., aramid yarns, blown swellable fibers, etc.), insulating materials, dielectric materials, flame retardants, flame suppressants or extinguishants, and/or other materials.

A wide variety of other types of moisture mitigation techniques, materials, and/or components may be utilized in various embodiments. The techniques described with reference to FIGS. 1-4 are provided by way of non-limiting example only. Other techniques may be utilized to absorb water vapor that penetrates a premise cable and/or to block the penetration of the water vapor. Additionally, in certain embodiments, a plurality of suitable moisture mitigation techniques may be combined within a single cable.

As a result of utilizing one or more of the moisture mitigation techniques described herein and/or contemplated by this disclosure, improved premise cables may be developed. As a result of the moisture mitigation techniques, water vapor may be absorbed as it penetrates an outer jacket of a premise cable and/or subsequent to penetrating an outer jacket of the premise cable. Thus, the relative humidity inside the cable may be lowered relative to the cable's external environment. As a result, cable integrity and performance may be maintained at desirable levels regardless of any adverse environmental conditions, such as higher temperatures and/or higher humidity. Further, with the use of moisture mitigation techniques, it may be possible to lower the overall cost of certain premise cables. For example, less expensive types of insulation and/or jacket materials (e.g., FEP, etc.) and/or lower amounts of these materials may be utilized while providing adequate overall cable performance.

Although twisted pair communication cables are primarily discussed herein, other embodiments are equally applicable to other types of premise cables. For example, a moisture mitigation materials and/or components may be utilized in premise cables that include one or more conductors other than twisted pairs (e.g., premise energy cables, etc.), such as solid or stranded conductors. As another example, moisture mitigation materials and/or components may be utilized in hybrid or composite cables that include a plurality of different types of transmission media, such as a combination of twisted pairs and other types of conductors (e.g., energy or power conductors). Indeed, various embodiments may be applicable to a wide variety of different types of premise cables.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A premise cable comprising:

a jacket defining a cable core;

a plurality of twisted pairs of individually insulated conductors positioned within the cable core; and moisture mitigation material positioned loosely within the cable core and free to migrate within the interstices between the plurality of twisted pairs, the moisture mitigation material configured to absorb water vapor that penetrates the jacket when the cable is installed in an indoor environment, wherein the moisture mitigation material does not block the migration of liquid water along the cable in a longitudinal direction.

2. The premise cable of claim 1, wherein the moisture mitigation material lowers the humidity within the cable core relative to the humidity outside the jacket.

3. The premise cable of claim 1, wherein the moisture mitigation material comprises a desiccant.

4. The premise cable of claim 1, wherein the moisture mitigation material comprises at least one of (i) calcium sulfate, (ii) silica gel, or (iii) sodium polyacrylate.

5. The premise cable of claim 1, wherein the moisture mitigation material is positioned at a plurality of discrete locations along a longitudinal length of the cable.

6. The premise cable of claim 5, further comprising one or more dams respectively positioned at discrete locations along the longitudinal length of the cable.

7. The premise cable of claim 1, wherein the moisture mitigation material comprises one of (i) an absorbent polymer or (ii) a superabsorbent polymer.

8. The premise cable of claim 1, wherein the moisture mitigation material comprises at least one of (i) a water absorbent yarn or (ii) a molecular sieve.

9. The premise cable of claim 1, wherein the premise cable satisfies at least one flame retardancy standard or burn standard for premise cables.

10. A premise cable configured for installation in an indoor environment, the premise cable comprising:

a jacket defining a cable core;

a plurality of individually insulated conductors positioned within the cable core;

moisture mitigation material positioned within the cable core and free to contact the plurality of conductors, the moisture mitigation material comprising a desiccant that absorbs water vapor that penetrates the jacket.

11. The premise cable of claim 10, wherein the moisture mitigation material fails to block the migration of liquid water within the cable core along a longitudinal direction.

12. The premise cable of claim 10, wherein the moisture mitigation material lowers the humidity within the cable core relative to the humidity outside the jacket.

13. The premise cable of claim 10, wherein the moisture mitigation material is loosely positioned within the cable core.

14. The premise cable of claim 10, wherein the moisture mitigation material is affixed to a substrate layer positioned between the jacket and the plurality of twisted pairs.

15. The premise cable of claim 10, wherein the premise cable satisfies at least one flame retardancy standard or burn standard for premise cables.

16. A premise cable comprising:

at least one twisted pair of individually insulated electrical conductors positioned within an opening defined by a cable jacket; and moisture mitigation material positioned within the opening and free to contact the at least one twisted pair, the moisture mitigation material configured to regulate the humidity within the opening in the event that water vapor penetrates the cable jacket.

17. The premise cable of claim 16, wherein the moisture mitigation material is configured to absorb water vapor that penetrates the jacket when the cable is installed in an indoor environment, and wherein the moisture mitigation material does not block the migration of liquid water along the cable in a longitudinal direction.

18. The premise cable of claim 16, wherein the moisture mitigation material comprises one of (i) calcium sulfate, (ii) silica gel, or (iii) sodium polyacrylate.

19. The premise cable of claim 16, wherein the moisture mitigation material is loosely positioned within the cable core.

20. The premise cable of claim 16, wherein the premise cable satisfies at least one flame retardancy standard or burn standard for premise cables.

* * * * *